United States Patent [19]

China

[11] 4,300,610

[45] Nov. 17, 1981

[54] CARD-LIKE HOLDER

[75] Inventor: David B. China, Gainsville, Fla.

[73] Assignee: Bermas Plastics Company, Inc., Long Island City, N.Y.

[21] Appl. No.: 117,094

[22] Filed: Jan. 31, 1980

[51] Int. Cl.[3] ..... A45C 11/32; A45C 15/00

[52] U.S. Cl. ..... 150/40; 206/37

[58] Field of Search ..... 206/37, 38, 0.82, 0.83, 206/0.84; 150/40

[56] References Cited

U.S. PATENT DOCUMENTS

| | | | |
|---|---|---|---|
| 2,756,794 | 7/1956 | Buckett | 150/40 |
| 2,859,789 | 11/1958 | Buckett | 150/40 |
| 3,178,014 | 4/1965 | Goldwasser | 206/0.83 |
| 3,212,546 | 10/1965 | Lind | 150/40 |
| 3,262,479 | 7/1966 | Leguillon | 150/40 |
| 3,788,464 | 1/1974 | Skinner | 206/0.82 |
| 3,957,157 | 5/1976 | Therrien | 206/0.83 |
| 4,037,716 | 7/1977 | Marks | 206/38 |

*Primary Examiner*—William T. Dixson, Jr.

*Attorney, Agent, or Firm*—Morgan, Finnegan, Pine, Foley & Lee

[57] ABSTRACT

A holder for keys, coins and the like is generally rectangular in cross-section so that it has an appearance similar to that of a standard credit card. The card-like holder includes a tray member and an insert member which is receivable within the tray member. The tray member includes a rigid frame having opposed faces and an aperture for receiving the insert member. The tray member also includes a flexible film which is disposed over one of the frame faces to form a backing for the frame aperture. The insert member conforms in configuration to the frame aperture so as to be receivable therein. The insert includes a rigid holder portion having a pair of opposed faces and an aperture for receiving the item to be contained in the holder. The insert also includes a flexible film member disposed over one of the insert holder portion faces to form a backing for the insert aperture.

9 Claims, 3 Drawing Figures

CARD-LIKE HOLDER

BACKGROUND OF THE INVENTION

1. Field of the Invention

The present invention relates to a holder for keys, coins and the like. More particularly, the present invention relates to a key holder having an appearance similar to that of a credit card which may be used as an advertising or promotional item.

2. The Prior Art

Card-like holders for spare keys, coins and the like are known in the prior art. One type of prior art card-like holder consists of a card member having slots in which keys are inserted thus allowing the ends or edges of the keys to extend from the surface of the holder. Such a configuration, however, is undesirable in that the key extensions can catch or bind on clothing, pockets etc. Another type of card-like holder consists of a card member having pockets for receiving keys, and means for restraining the keys within the card pockets. Such restraining means typically include adhesive or magnetic strips disposed across the surface of the keys and card or an adhesive film substantially covering the card face which includes the key containing pockets. The use of adhesive or magnetic strips is undesirable in that it is cumbersome; the strips may be easily misplaced and/or become worn after a period of use; and portions of the keys contained in the holder are plainly visible to a prospective thief. The use of a resealable adhesive film is undesirable in that after a period of use the film may become worn such that it no longer properly adheres to the card holder thus resulting in the possible loss of the items contained in the holder.

It is an object of the present invention to provide a card-like holder for keys, coins and the like which is sturdy and does not rely upon adhesive or magnetic strips, or a resealable film for restraining the contents of the holder therein.

It is another object of the present invention to provide a card-like holder for keys, coins and the like which fully encloses and conceals from view the items contained therein.

It is a further object of the present invention to provide a card-like holder for keys, coins and the like which is inexpensive to manufacture and which includes ample surface area for printed indicia such that the holder may be used as a promotional item.

SUMMARY OF THE INVENTION

In accordance with the above-recited objectives the present invention provides a holder for keys, coins and the like which is generally rectangular in cross-section so that it has an appearance similar to that of a standard credit card. The subject card-like holder includes a tray member and an insert member receivable within the tray member. The tray member includes a rigid frame portion having opposed faces and an aperture for receiving the insert member. The tray member also includes a flexible film disposed over one of the faces of the frame to form a backing for the frame aperture. The insert member conforms in configuration to the frame aperture so as to be receivable therein. The insert includes a rigid holder portion having a pair of opposed faces and an aperture for receiving the item to be contained in the holder. The insert also includes a flexible film member disposed over one of the faces of the insert holder portion to form a backing for the insert aperture.

DETAILED DESCRIPTION OF THE PREFERRED EMBODIMENTS

Figure 1:
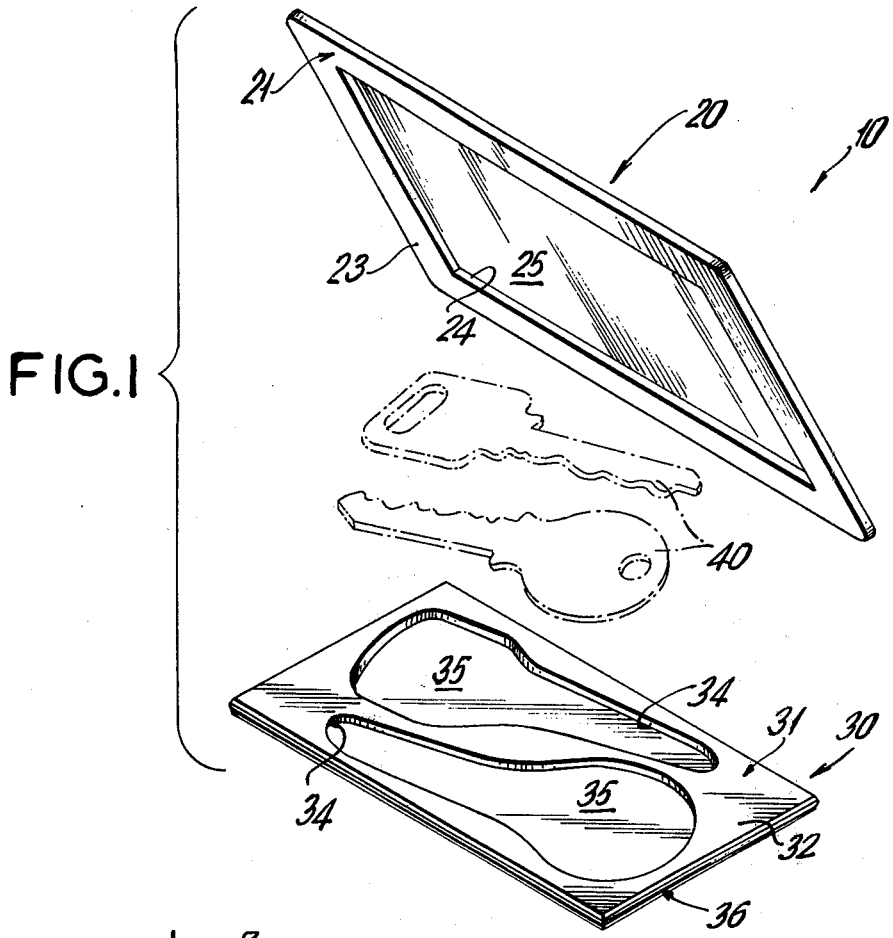
FIG. 1 is an exploded perspective view, phantom in part, of the card-like holder of the present invention.
Figure 2:
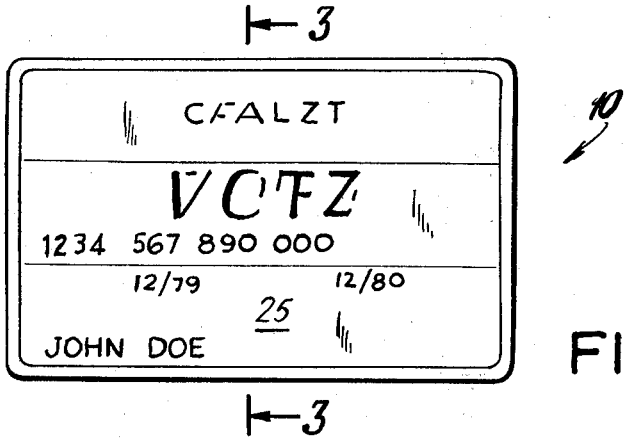
FIG. 2 is a plan view of the card-like holder of the present invention.
Figure 3:
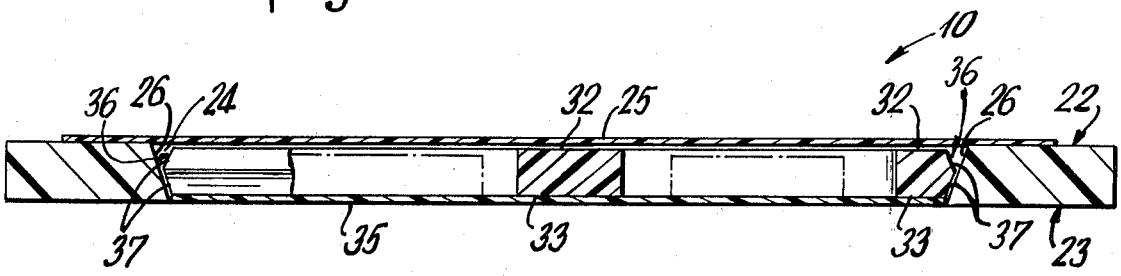
FIG. 3 is a cross-sectional view of the card-like holder of the present invention taken along line 3—3 of FIG. 2.

Referring to FIGS. 1–3, the holder of the present invention is designated generally by reference numeral 10, and is preferably rectangular in configuration having such dimensions that it is similar in appearance to a standard credit card. As illustrated, holder 10 comprises a substantially rectangular tray member 20 and an insert member 30 which is reversibly receivable within tray member 20. Tray member 20 includes a rigid frame portion 21 having opposed faces 22 and 23. Frame portion 21 may be formed from any rigid material, but is preferably formed from a moldable plastic material such as a high density polyethylene, vinyl, or the like, which in addition to being rigid is also somewhat elastic and flexible. Frame portion 21 includes an aperture 24, which may be substantially rectangular in configuration and a film member 25 which is disposed over one of the faces of frame portion 21, such as face 22, to form a backing for frame aperture 24. Film 25 is preferably formed from a material such as vinyl or polyethylene which may be easily heat sealed to frame 21, and which is both resistant to rupture and yet quite flexible and elastic. Preferably, film 25 has a thickness on the order of about 0.004 to 0.010 inches. As shown most clearly in FIG. 3, tray aperture 24 defines an inner peripheral edge portion 26, which is preferably undercut and disposed at an angle relative to frame faces 22 and 23 such that frame portion 21 decreases in width from face 23 to face 22. The purpose of such undercut will be discussed below.

Referring to FIGS. 1 and 3, insert member 30 of the subject card-like holder has a configuration which conforms to that of tray member aperture 24 such that insert 30 may be receivable within aperture 24 in resistance fit relationship. In addition, insert member 30 includes a rigid holder portion 31 having opposed faces 32 and 33 and apertures 34. As illustrated in FIG. 1, apertures 34 have a configuration similar to that of keys 40 which are to be contained within the holder. Preferably, insert holder portion 31 like tray member frame portion 21, is formed from a moldable plastic material such as a high density polyethylene vinyl or the like. Such material provides insert 30 with both rigidity and flexibility. Insert 30 also includes a film member 35 which is disposed on one of the faces of holder portion 31, such as face 32 thereof, so as to form a backing for insert apertures 34. Preferably, insert film member 35, like tray film 25, is formed from a material such as vinyl or polyethylene which can be easily heat sealed onto holder portion 31, and which is both resistant to rupture yet quite flexible and elastic. Insert member 30 also preferably includes an exterior peripheral edge 36 having beveled portions 37, each of which being disposed at substantially the same angle relative to frame faces 22 and 23 as the undercut of interior frame edge portion 26 when insert 30 is disposed within frame aperture 24 (see FIG. 3). The provision of undercut 26 in tray member 20 and beveled edge portions 37 on insert 30 facilitate the entry and exit of insert 30 from tray 20, and provide a snap-lock for insert 30.

In operation, the item to be contained within holder 10, such as keys 40, are loaded into insert apertures 34. Insert 30 is then received and snap locked into tray frame aperture 24 with keys 40 being disposed adjacent tray backing 25. In accordance with the invention, the items (keys 40) contained within card holder 10 are fully enclosed therein and hidden from view. The flexibility of tray frame member 21 and insert holder 31 along with that of film members 25 and 35 provide for the easy ejection of insert 30 from tray member 20, and of keys 40 from insert member 30. Referring to FIG. 2, it will be noted that film member 25 may include printed indicia such that card holder 10 may be used as an advertising or promotional item. It will be understood that film 35 may also include printed indicia such that both faces of the card may be fully utilized for promotional purposes.

In summary, the present invention provides a holder for keys, coins or the like which has a configuration similar to that of a standard credit card and thus is easily portable. The subject holder encloses the items to be contained therein without the need of magnetic or adhesive strips, and fully hides the items enclosed from view. In addition, because of its particular construction the subject card holder includes maximum area for printed indicia and thus may be readily used as an advertising or promotional item. The fact that the subject card holder may also be very inexpensively manufactured renders it quite suitable for this purpose.

While there have been described herein what are at present considered preferred embodiments of the invention, it will be obvious to those skilled in the art that many modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A reusable card-like holder for a key, coin, and/or similar item comprising:

a tray member including a rigid frame portion having a pair of opposed faces, said tray member including an aperture and a first film member disposed on one of the faces of said frame portion so as to define a backing for said frame aperture; and an insert member conforming in configuration to that of said tray member aperture such that said insert member is removably receivable, in resistance fit relationship, within said tray member aperture, said insert member including a rigid holder portion having a pair of opposed faces, said holder portion also including an aperture for receiving said key, coin and/or similar item, said insert member further including a second film member disposed on one of the faces of said holder portion so as to define a backing for said insert member aperture and such that said item, when contained within the holder, is sandwiched between said first and second film members, said tray member and insert member being flexible such that said insert member may be readily snapped into and out of said tray member for containing or ejecting said item.

2. A card-like holder as recited in claim 1 wherein said tray member is formed from a moldable plastic material.

3. A card-like holder as recited in claim 1 wherein said insert member holder portion is formed from a moldable plastic material.

4. A card-like holder as recited in claim 1 wherein said tray member aperture defines an inner peripheral edge portion which is undercut and disposed at an angle relative to said opposed frame faces such that said frame portion increases in width from said frame face over which said first film member is disposed to said opposed frame face; and said holder portion of said insert member includes an exterior peripheral edge having a beveled portion which is disposed at substantially the same angle relative to said frame faces as the undercut interior frame edge portion to facilitate entry and exit of said insert member from said tray member.

5. A card-like holder as recited in claim 1 wherein said first and second film members comprise a heat sealable plastic which is elastic and resistant to rupture.

6. A card-like holder as recited in claim 5 wherein said first and second film members are formed from polyethylene.

7. A card-like holder as recited in claim 5 wherein said first and second film members are formed from vinyl.

8. A card like holder as recited in claim 1 wherein said first and second film members are elastic and have a thickness in the range of about 0.004 to 0.010 inches.

9. A reusable card-like holder for a key, coin, and/or similar item comprising:

a tray member including a rigid frame portion formed from a moldable plastic material, said frame portion having a pair of opposed faces and including an aperture and a first film member disposed on one of the faces of said frame portion so as to define a backing for said frame aperture, said frame aperture defining an inner peripheral edge portion which is undercut and disposed at an angle relative to said opposed frame faces such that said frame portion increases in width from said frame face over which said first film member is disposed to said opposed frame face, said first film member being formed from a heat sealable plastic which is elastic and resistant to rupture; and an insert member conforming in configuration to that of said tray member aperture such that said insert member is removably receivable, in resistance fit relationship, within said tray member aperture, said insert member including a rigid holder portion formed from a moldable plastic material, said holder portion having a pair of opposed faces, said holder portion also including an aperture for receiving said key, coin and/or similar item, said insert member further including a second film member disposed on one of the faces of said holder portion so as to define a backing for said insert member aperture, said item, when contained in the holder, being sandwiched between said first and second film members, said second film member being formed from a heat sealable plastic material, said insert member holder portion including an exterior peripheral edge having a beveled portion which is disposed at substantially the same angle relative to said frame faces as the undercut interior edge portion of said frame portion to facilitate entry and exit of said insert member from said tray member, said tray member and insert member being flexible and said first and second film members being elastic and having a thickness in the range of about 0.004 to 0.010 inches such that said insert member may be readily snapped into and out of said tray member for containing or ejecting said item.

* * * * *